US010422109B2

(12) United States Patent
Kawashima

(10) Patent No.: US 10,422,109 B2
(45) Date of Patent: Sep. 24, 2019

(54) SHOVEL AND METHOD OF CONTROLLING SHOVEL

(71) Applicant: SUMITOMO HEAVY INDUSTRIES, LTD., Tokyo (JP)

(72) Inventor: Koji Kawashima, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 201 days.

(21) Appl. No.: 15/391,904

(22) Filed: Dec. 28, 2016

(65) Prior Publication Data

US 2017/0107697 A1 Apr. 20, 2017

Related U.S. Application Data

(63) Continuation of application No. PCT/JP2015/069025, filed on Jul. 1, 2015.

(30) Foreign Application Priority Data

Jul. 3, 2014 (JP) ..... 2014-137953

(51) Int. Cl.
*E02F 9/22* (2006.01)
*F15B 11/08* (2006.01)
(Continued)

(52) U.S. Cl.
CPC ..... *E02F 9/2285* (2013.01); *E02F 9/123* (2013.01); *E02F 9/22* (2013.01); *E02F 9/2207* (2013.01);
(Continued)

(58) Field of Classification Search
CPC ..... E02F 9/2207; E02F 9/2214; F15B 11/166; F15B 2211/355; F15B 2211/635; F15B 2211/67
See application file for complete search history.

(56) References Cited

U.S. PATENT DOCUMENTS 6,837,140 B2 * 1/2005 Oka ..... E02F 9/2207 91/33
2004/0045289 A1 * 3/2004 Ikeda ..... E02F 3/384 60/469
(Continued)

FOREIGN PATENT DOCUMENTS

EP 0620370 10/1994
EP 0785313 7/1997
(Continued)

OTHER PUBLICATIONS

International Search Report dated Aug. 18, 2015.

*Primary Examiner* — F Daniel Lopez
*Assistant Examiner* — Matthew Wiblin
(74) *Attorney, Agent, or Firm* — IPUSA, PLLC

(57) ABSTRACT

A shovel includes a turning hydraulic motor, a hydraulic cylinder, a pilot circuit, a hydraulic control valve, a variable throttle, and a controller. The turning hydraulic motor is driven with hydraulic oil supplied from the hydraulic pump to drive a turning body of the shovel to turn. The hydraulic cylinder is driven with the hydraulic oil supplied from the hydraulic pump. The pilot circuit controls a pilot pressure in accordance with the operation of an operation lever. The hydraulic control valve controls the hydraulic oil supplied from the hydraulic pump to the hydraulic cylinder in accordance with the pilot pressure supplied from the pilot circuit. The opening of the variable throttle varies in accordance with the operating state of the operation lever. The controller changes the opening of the variable throttle.

12 Claims, 8 Drawing Sheets

(51) Int. Cl.

| | |
|---|---|
| ***F15B 13/04*** | (2006.01) |
| ***F15B 13/042*** | (2006.01) |
| ***E02F 9/12*** | (2006.01) |
| *E02F 3/32* | (2006.01) |

(52) U.S. Cl.
CPC ..... *E02F 9/2228* (2013.01); *E02F 9/2239* (2013.01); *E02F 9/2292* (2013.01); *F15B 11/08* (2013.01); *F15B 13/0401* (2013.01); *F15B 13/042* (2013.01); *E02F 3/32* (2013.01); *F15B 2211/40515* (2013.01); *F15B 2211/575* (2013.01); *F15B 2211/7058* (2013.01)

(56) References Cited

U.S. PATENT DOCUMENTS

| | | | | |
|---|---|---|---|---|
| 2014/0150416 | A1 | 6/2014 | Lee | |
| 2015/0292184 | A1* | 10/2015 | Kondo | E02F 9/2203 60/463 |

FOREIGN PATENT DOCUMENTS

| | | | | | |
|---|---|---|---|---|---|
| EP | 2354331 | | | 8/2011 | |
| JP | S53-032297 | U | | 8/1976 | |
| JP | 05157101 | A | * | 6/1993 | E02F 9/2207 |
| JP | H05-157101 | | | 6/1993 | |
| JP | H11-061889 | | | 3/1999 | |
| JP | 2008-224039 | | | 9/2008 | |

* cited by examiner

SHOVEL AND METHOD OF CONTROLLING SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2015/069025, filed on Jul. 1, 2015 and designating the U.S., which claims priority to Japanese Patent Application No. 2014-137953, filed on Jul. 3, 2014. The entire contents of the foregoing applications are incorporated herein by reference.

BACKGROUND

Technical Field

The present invention relates to shovels and methods of controlling a shovel.

Description of Related Art

In shovels, a boom, an arm, and a bucket are generally driven by respective hydraulic cylinders. Hydraulic oil supplied to the hydraulic cylinders or hydraulic oil discharged from the hydraulic cylinders is controlled by a control valve. Furthermore, the opening and closing of valves in the control valve is controlled by a pilot hydraulic system different from a drive hydraulic system.

For example, a pilot pressure for controlling the driving of a boom cylinder for driving the boom is controlled by a boom operation lever to be supplied to the control valve. That is, a pilot pressure commensurate with the amount of operation of the boom operation lever is supplied to the control valve. The control valve opens or closes in accordance with this pilot pressure to allow hydraulic oil to be supplied to the boom cylinder or allow hydraulic oil to be discharged from the boom cylinder.

Here, for example, consideration is given to the case where an operator of the shovel operates the boom operation lever during turning to raise and thereafter stop the boom. In this case, first, a pilot pressure commensurate with the amount of operation of the boom operation lever is supplied to the control valve, so that the control valve is controlled to allow high-pressure hydraulic oil to be supplied to the bottom side of the boom cylinder. As a result, the boom rises. When the operator returns the boom operation lever to a neutral position to stop the boom, the pilot pressure becomes substantially zero, so that the control valve closes to stop hydraulic oil from being supplied to the bottom side of the boom cylinder. Usually, the operator returns the boom operation lever to a neutral position in a rapid action. Therefore, the pilot pressure as well rapidly decreases to become a value close to zero.

When the boom rises and thereafter rapidly decelerates to stop as in the above-described case, the hydraulic pressure in the boom cylinder changes because of the rapid deceleration of the boom. This change of the hydraulic pressure changes the hydraulic pressure at the hydraulic supply port of a turning hydraulic motor as well, so that the turning body of the shovel swings in the turning direction. Such swinging of the vehicle body of the shovel is unpleasant to the operator.

SUMMARY

According to an aspect of the present invention, a shovel includes a turning hydraulic motor, a hydraulic cylinder, a pilot circuit, a hydraulic control valve, a variable throttle, and a controller. The turning hydraulic motor is driven with hydraulic oil supplied from the hydraulic pump to drive a turning body of the shovel to turn. The hydraulic cylinder is driven with the hydraulic oil supplied from the hydraulic pump. The pilot circuit controls a pilot pressure in accordance with the operation of an operation lever. The hydraulic control valve controls the hydraulic oil supplied from the hydraulic pump to the hydraulic cylinder in accordance with the pilot pressure supplied from the pilot circuit. The opening of the variable throttle varies in accordance with the operating state of the operation lever. The controller changes the opening of the variable throttle.

According to an aspect of the present invention, a method of controlling a shovel that includes a turning hydraulic motor configured to be driven with hydraulic oil supplied from a hydraulic pump to drive a turning body of the shovel to turn, a hydraulic cylinder configured to be driven with the hydraulic oil supplied from the hydraulic pump, a pilot circuit configured to control a pilot pressure in accordance with the operation of an operation lever, a hydraulic control valve configured to control the hydraulic oil supplied from the hydraulic pump to the hydraulic cylinder in accordance with the pilot pressure supplied from the pilot circuit, and a variable throttle whose opening varies in accordance with a state of the operation of the operation lever, includes changing, by a controller of the shovel, the opening of the variable throttle in accordance with the state of the operation of the operation lever.

DETAILED DESCRIPTION

When stopping a rising boom, the hydraulic circuit of the above-described work machine prevents the spool of a directional control valve from rapidly returning to a neutral position to reduce an impact due to the inertial load of the boom at the time of stopping. Shovels, however, operate under various conditions. Therefore, a fixed throttle mechanism alone may be unable to sufficiently prevent the spool of the directional control valve from returning to a neutral position, thus causing a large swing of the turning body.

Therefore, there is a demand for control of the swinging of a vehicle body due to an operator's lever operation.

According to an embodiment of the present invention, a shovel having a vehicle body reduced in swinging is provided.

Figure 1:
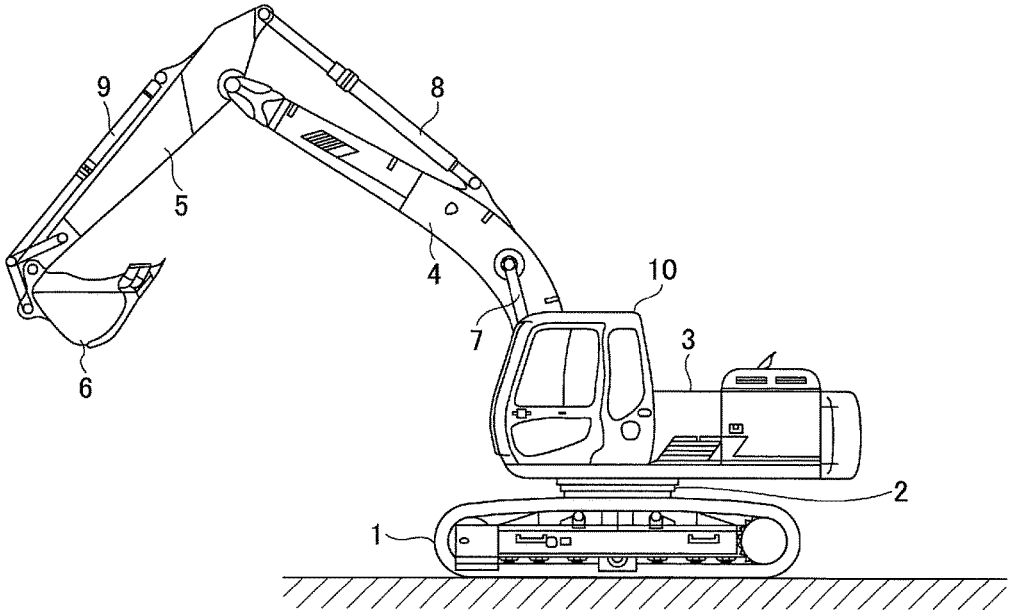
FIG. 1 is a side view of a shovel.

FIG. 1 is a side view of a shovel (excavator) according to an embodiment of the present invention. An upper-part turning body 3 is mounted on a lower-part traveling body 1 of the shovel via a turning mechanism 2. A boom 4 is attached to the upper-part turning body 3. An arm 5 is attached to the end of the boom 4, and a bucket 6 is attached to the end of the arm 5. The boom 4, the arm 5, and the bucket 6 are hydraulically driven by a boom cylinder 7, an arm cylinder 8, and a bucket cylinder 9, respectively, which are hydraulic cylinders. A cabin 10 is provided and power sources such as an engine are mounted on the upper-part turning body 3.

Figure 2:
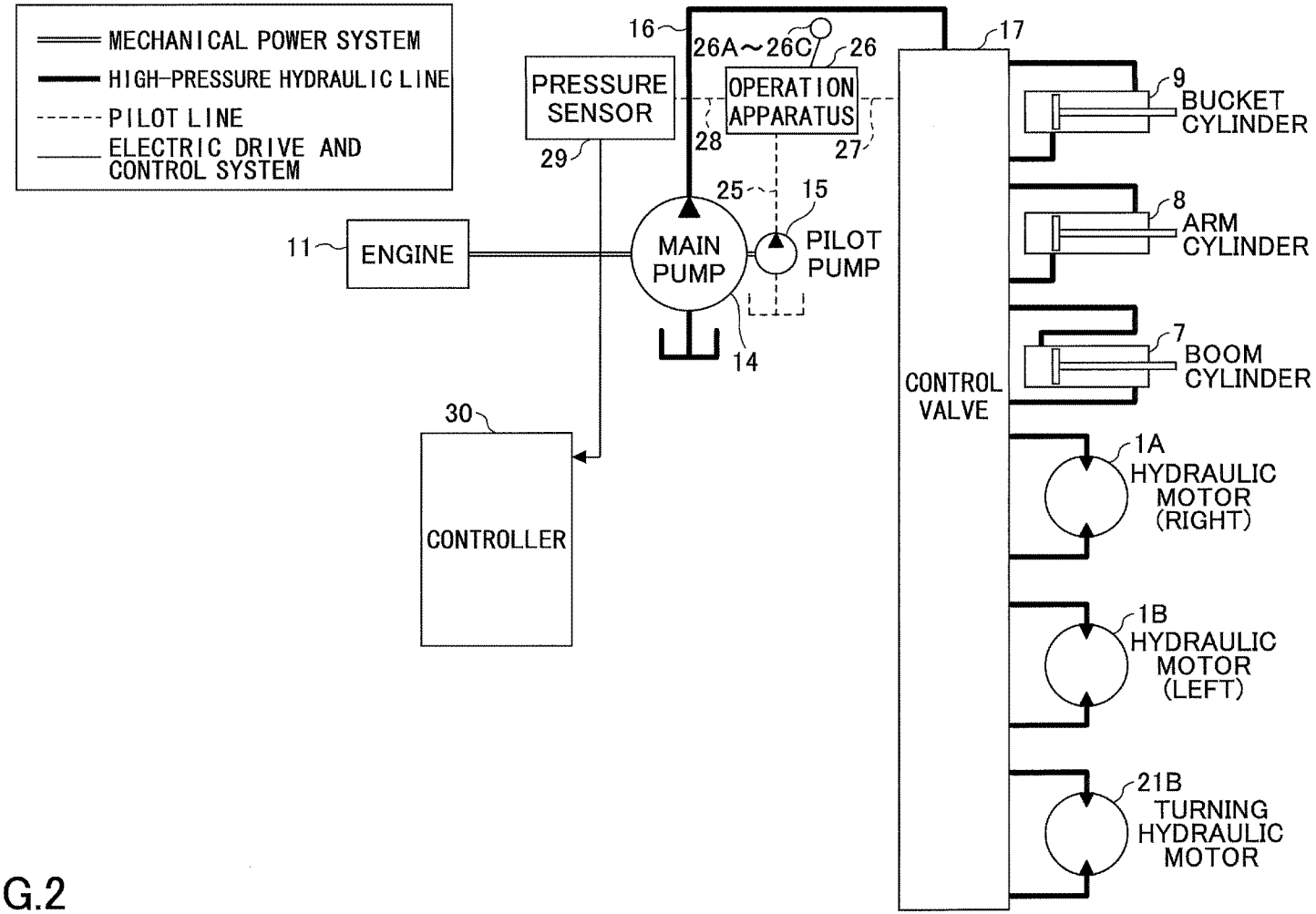
FIG. 2 is a block diagram showing a configuration of a drive system of the shovel shown in FIG. 1.

FIG. 2 is a block diagram showing a configuration of a drive system of the shovel shown in FIG. 1. In FIG. 2, a mechanical power system, a high-pressure hydraulic line, a pilot line, and an electric drive and control system are indicated by a double line, a thick solid line, a dashed line, and a thin solid line, respectively.

A main pump 14 and a pilot pump 15 serving as hydraulic pumps are connected to the output shaft of an engine 11 serving as a mechanical drive part. A control valve 17 serving as a hydraulic control valve is connected to the main pump 14 via a high-pressure hydraulic line 16. Furthermore, an operation apparatus 26 is connected to the pilot pump 15 via a pilot line 25.

The control valve 17 is a device that controls a hydraulic system in the hydraulic shovel. Hydraulic actuators, such as traveling hydraulic motors 1A (right) and 1B (left) for the lower-part traveling body 1, the boom cylinder 7, the arm cylinder 8, the bucket cylinder 9, and a turning hydraulic motor 21B, are connected to the control valve 17 via high-pressure hydraulic lines. The operation apparatus 26 is connected to the control valve 17 via a hydraulic line 27 serving as a pilot line.

The operation apparatus 26 includes a lever 26A, a lever 26B, and a pedal 26C. The lever 26A, the lever 26B, and the pedal 26C are connected to the control valve 17 and a pressure sensor 29 via the hydraulic line 27 and a hydraulic line 28, respectively. The pressure sensor 29 is connected to a controller 30 that controls driving of an electric system.

The controller 30 operates as a main control part that controls driving of the hydraulic shovel. The controller 30 includes a processor including a CPU (Central Processing Unit) and an internal memory. The controller 30 is a control unit that is implemented by the CPU executing a drive control program contained in the internal memory.

In the shovel configured as described above, it is assumed that the lever 26A of the operation apparatus 26 is a lever for operating the boom 4 by an operator. For example, when the operator operates the lever 26A to raise the boom 4, a pilot pressure (hydraulic pressure) from the pilot pump 15 is controlled by the operation apparatus 26 in accordance with the amount of operation of the lever 26A. The pilot pressure controlled by the operation apparatus 26 is supplied to the control valve 17. In the control valve 17, a boom driving hydraulic circuit opens oil passages based on the supplied pilot pressure to allow high-pressure hydraulic oil from the main pump 14 to be supplied to the bottom side of the boom cylinder 7. As a result, the boom 4 rises.

Furthermore, letting the lever 26B be for a turning operation, the operator can drive the turning hydraulic motor 21B to turn the upper-part turning body 3 either rightward or leftward by operating the lever 26B.

Here, for example, consideration is given to the case of raising the boom 4 while turning the upper-part turning body 3. In this case, the turning hydraulic motor 21B is driven with hydraulic oil from the main pump 14, and at the same time, hydraulic oil is supplied to the bottom side of the boom cylinder 7. Driving the boom 4, the arm 5 or the like during turning as described above may be referred to as "complex turning."

Figure 3A:
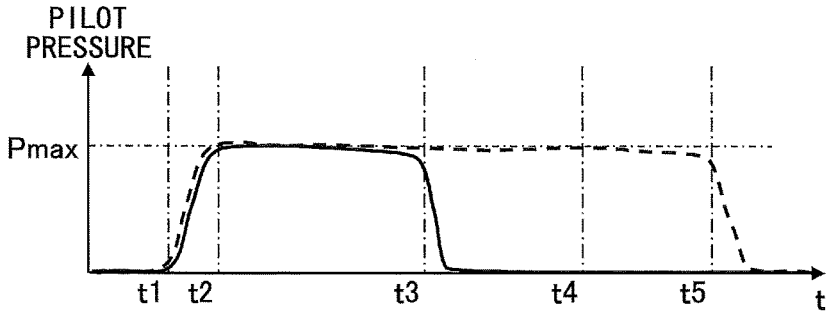
FIGS. 3A through 3C are graphs showing changes in pilot pressures, changes in the rotational speed of a turning hydraulic motor and the velocity of a boom, and changes in a turning B port pressure and a boom bottom pressure, respectively, in a complex turning action.
Figure 3B:
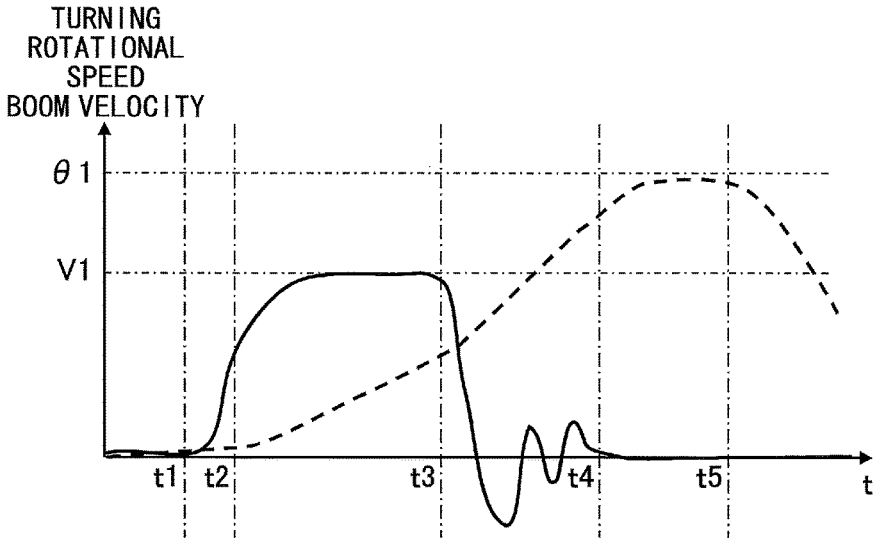
Figure 3C:
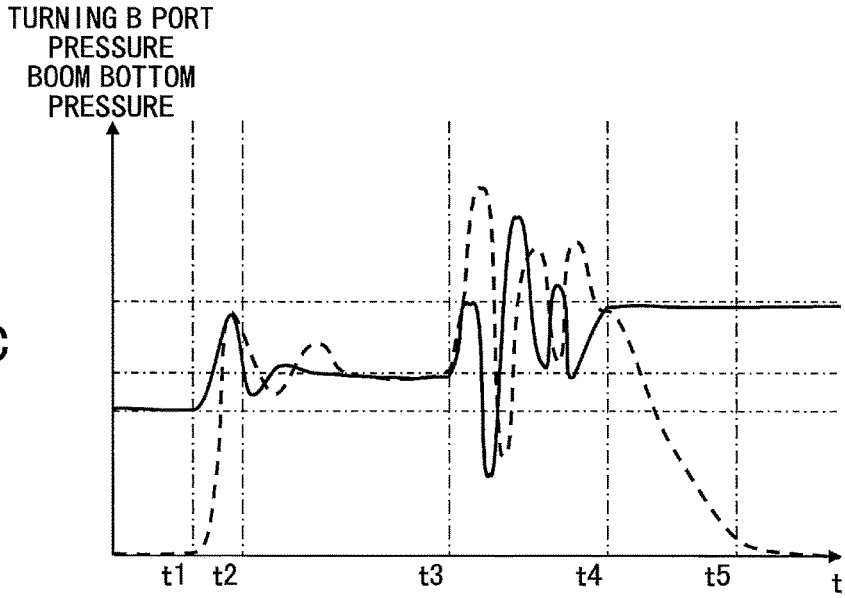

Consideration is given to the case where the rise of the boom 4 is stopped during the complex turning action as described above. FIGS. 3A, 3B, and 3C are graphs showing changes in pilot pressures, changes in the rotational speed of the turning hydraulic motor 21B and the velocity of the boom 4, and changes in the turning B port pressure and the boom bottom pressure, respectively, in the complex turning action.

In the case illustrated in FIGS. 3A through 3C, the lever 26A for boom operation and the lever 26B for turning operation are simultaneously operated to start a turning action and a boom raising action at time t1. Then, at time t2, the lever 26A and the lever 26B are kept fully tilted. At time t3, the lever 26A for boom operation alone is returned to a neutral position to stop raising the boom 4. At time t5 after time t4, the lever 26B for turning operation as well is returned to a neutral position.

When the complex turning operation as described above is performed, the pilot pressure for boom operation (solid line) and the pilot pressure for turning operation (dashed line) change as shown in FIG. 3A. That is, the pilot pressure for boom operation and the pilot pressure for turning operation start to rise at time t1 to be maximized (Pmax) at time t2, and remain maximized until time t3.

When the lever 26A for boom operation is returned to the neutral position at time t3, the pilot pressure for boom operation (solid line) rapidly decreases to near zero, and thereafter remains near zero. The pilot pressure for turning operation (dashed line) remains maximized (Pmax) until time t5, and starts to decrease at time t5 to become near zero when the lever 26B for turning operation is returned to the neutral position at time t5.

As shown in FIG. 3B, the velocity of the boom 4 (boom velocity: solid line) reaches a maximum rise velocity V1 after time t2, and after remaining V1, starts to rapidly decrease at time t3 when the lever 26A for boom operation is returned to the neutral position. Then, the boom velocity swings in the negative direction (moving in the opposite direction [lowering]) after becoming zero, and repeats increasing and decreasing a few times to become zero. Then, the boom 4 stops at time t4. The swinging of the boom 4 swings the bottom-side hydraulic pressure of the boom cylinder 7 (boom bottom pressure: solid line) between time t3 and time t4 as shown in FIG. 3C.

As shown in FIG. 3B, while the turning velocity of the upper-part turning body 3, namely, the rotational speed of the upper-part turning body 3 (turning rotational speed: dashed line), increases at a constant rate of increase between time t2 and time t3, the rate of increase suddenly increases shortly after time t3. This is because the supply of hydraulic oil to the bottom side of the boom cylinder 7 is stopped at time t3. This is shown by a sudden increase in the slope of the line indicating the turning rotational speed shortly after time t3. Then, because the boom bottom pressure converges to a certain pressure while swinging, its effect reaches the B port (hydraulic supply side port) of the turning hydraulic motor 21B. That is, a great variation in the boom bottom pressure affects the hydraulic pressure at the B port of the turning hydraulic motor 21B (turning B port pressure: dashed line), so that the turning B port pressure as well varies as shown in FIG. 3C. This is because a circuit for supplying a hydraulic pressure to the boom cylinder 7 and a circuit for supplying a hydraulic pressure to the turning hydraulic motor 21B are formed in the same single hydraulic drive circuit.

When the turning B port pressure thus varies (swings), the torque of the turning hydraulic motor 21B also varies to cause small variations in the rotational speed of the upper-part turning body 3 (turning rotational speed). This turns into the swinging of the upper-part turning body 3 in the turning direction to become the swinging of the vehicle body with which the operator feels uncomfortable. While the turning rotational speed is indicated as increasing at a constant rate of increase between time t3 and time t4 in FIG. 3B, microscopically, the rate of increase of the turning rotational speed swings with the swinging of the turning B port pressure as shown in FIG. 3C.

According to this embodiment, a special circuit is provided in a pilot hydraulic circuit to control the swinging of a vehicle body as described above. A pilot hydraulic circuit according to this embodiment is described below.

Figure 4:
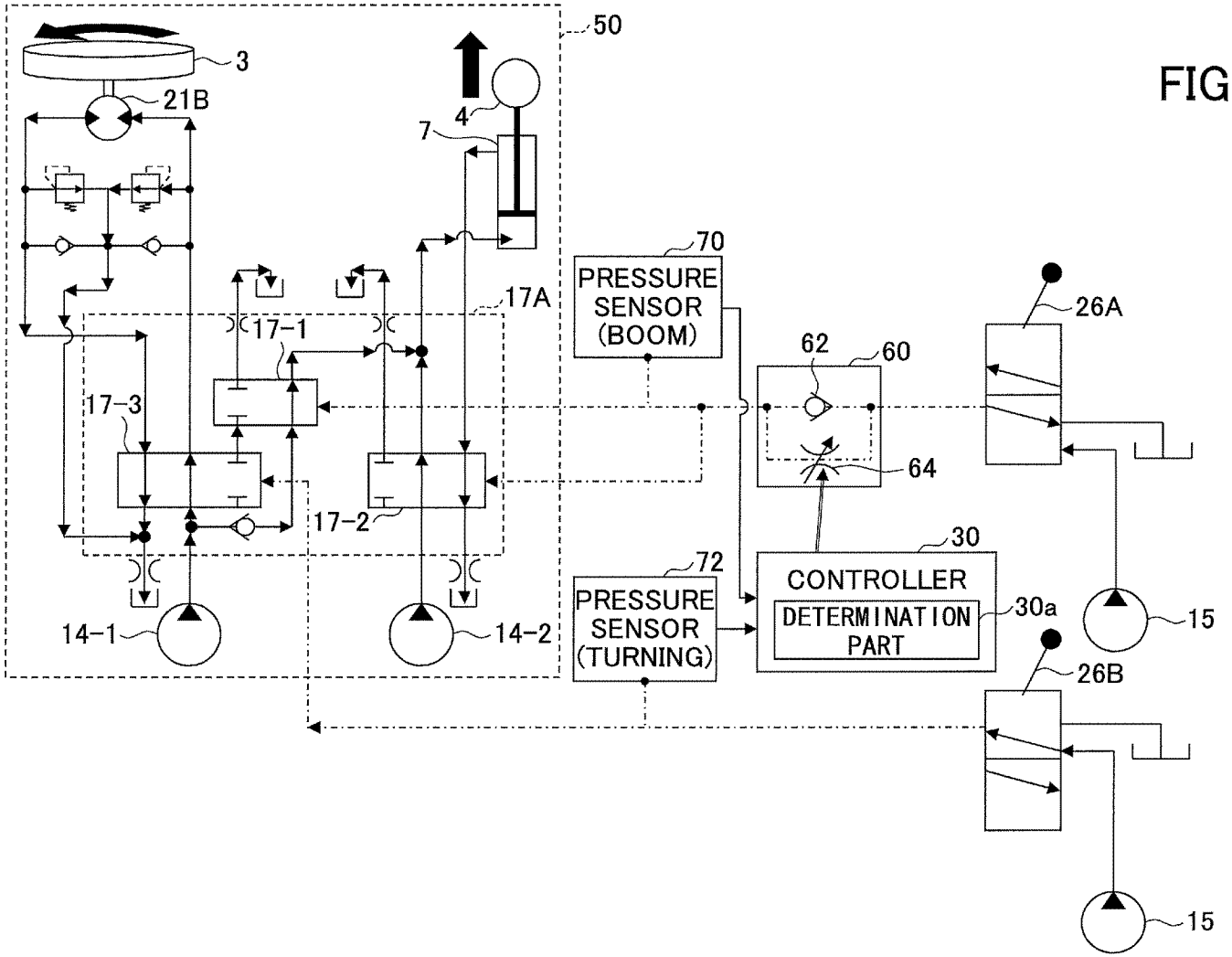
FIG. 4 is a circuit diagram showing a configuration of a hydraulic drive circuit including a pilot hydraulic circuit.

FIG. 4 is a circuit diagram showing a configuration of a hydraulic drive circuit including a pilot hydraulic circuit according to this embodiment. FIG. 4 shows a hydraulic drive circuit for driving the turning hydraulic motor 21B and the boom cylinder 7 and a pilot hydraulic circuit for controlling the turning hydraulic motor 21B and the boom cylinder 7. For a simpler explanation, however, for example, a hydraulic drive circuit for driving the arm cylinder 8 and the bucket cylinder 9 is omitted.

In FIG. 4, a hydraulic drive circuit part 50 enclosed by a dashed line includes a hydraulic circuit for driving the turning hydraulic motor 21B for driving the upper-part turning body 3 to turn and a hydraulic circuit for driving the boom cylinder 7 to reciprocate.

Furthermore, a hydraulic circuit part 17A enclosed by a dashed line in the hydraulic drive circuit part 50 represents a hydraulic circuit provided in the control valve 17.

The hydraulic circuit part 17A is supplied with a pilot pressure from a pilot hydraulic circuit. To be more specific, a pilot pressure controlled by the lever 26A for boom operation is supplied to spool valves 17-1 and 17-2 of the control valve 17. Furthermore, a pilot pressure controlled by the lever 26B for turning operation is supplied to a spool valve 17-3 of the control valve 17. The spool valves 17-1, 17-2, and 17-3 are valves in which a spool is pressed by the pilot pressure to move in proportion to the pilot pressure to open an oil passage.

That is, when the lever 26A for boom operation is operated in a direction to raise the boom 4, hydraulic oil from the pilot pump 15 is controlled to a pilot pressure commensurate with the amount of operation of the lever 26A, and the controlled pilot pressure is supplied to the spool valves 17-1 and 17-2. The spools of the spool valves 17-1 and 17-2 are moved by the pilot pressure to open oil passages, so that hydraulic oil from main pumps 14-1 and 14-2 is supplied to the bottom side of the boom cylinder 7 through the spool valves 17-1 and 17-2, respectively. As a result, the boom 4 rises.

After operating the lever 26A, the operator returns the lever 26A to the neutral position to stop raising the boom 4. When the lever 26A is returned to the neutral position, the pilot pressure decreases to zero or near zero. As a result, the spools of the spool valves 17-1 and 17-2 move to close the oil passages to stop the supply of hydraulic oil to the boom cylinder 7. At this point, hydraulic oil of the pilot pressure supplied to the spool valves 17-1 and 17-2 is returned to a tank via the lever 26A (the operation apparatus 26). To return this hydraulic oil of the pilot pressure, a pilot cushion circuit 60 is provided between the lever 26A and the spool valves 17-1 and 17-2. The pilot cushion circuit 60 is a hydraulic circuit that includes a check valve 62 and a variable throttle 64 connected in parallel to the check valve 62. The variable throttle 64 forms an oil passage through which the hydraulic oil of the pilot pressure flows toward the tank when the pilot pressure is reduced to zero.

Here, according to this embodiment, the variable throttle 64 is thus provided in the pilot cushion circuit 60 to control the rate of returning the hydraulic oil of the pilot pressure to the tank to control the rate at which the spool valves 17-1 and 17-2 return to a neutral position.

The variable throttle 64 is a valve capable of varying its opening based on a signal from the controller 30. A determination part 30*a* that determines the state of a pilot pressure is provided in the controller 30 to vary the opening of the variable throttle 64 when the pilot pressure enters a predetermined state. For example, the opening of the variable throttle 64 at the time of stopping the complex action of boom raising and turning is made smaller than the opening of the variable throttle 64 at the time of stopping the single action of boom raising.

The determination part 30*a* determines the state of the pilot pressures described with reference to FIG. 3A. A detection value of a pressure sensor 70 that detects the pilot pressure for boom operation and a detection value from a pressure sensor 72 that detects the pilot pressure for turning operation are input to the determination part 30*a*. The determination part 30*a* determines, based on these two detection values, whether the rising of the boom 4 is ready to be stopped during the turning of the upper-part turning body 3. To be more specific, the determination part 30*a* determines whether the detection value from the pressure sensor 70 and the detection value from the pressure sensor 72 are both maximized (Pmax).

According to this embodiment, the determination part 30*a* detects pilot pressures using the pressure sensor 70 and the pressure sensor 72 to determine the state where the lever 26A for boom operation and the lever 26B for turning operation are both being operated (complex turning state). Alternatively, the determination part 30*a* may, for example, directly detect the tilt of the lever 26A and the tilt of the lever 26B using tilt sensors to determine the state where the lever 26A for boom operation and the lever 26B for turning operation are both being operated (complex turning state).

Figure 5A:
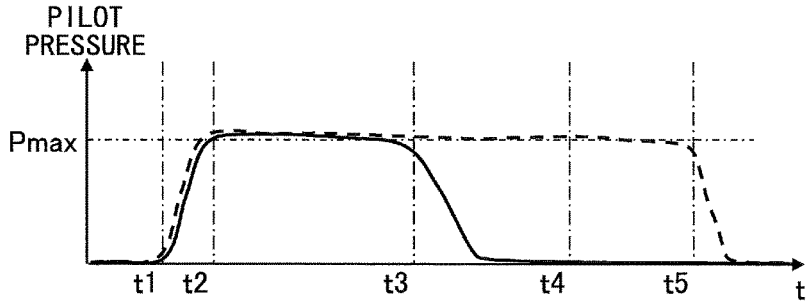
FIGS. 5A through 5C are graphs showing changes in pilot pressures, changes in the rotational speed of a turning hydraulic motor and the velocity of a boom, and changes in a turning B port pressure and a boom bottom pressure, respectively, in the case of reducing the opening of a variable throttle.
Figure 5B:
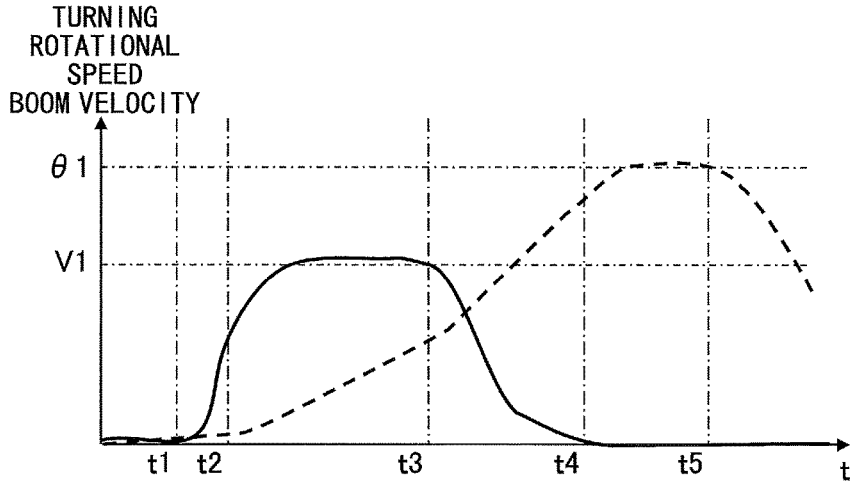
Figure 5C:
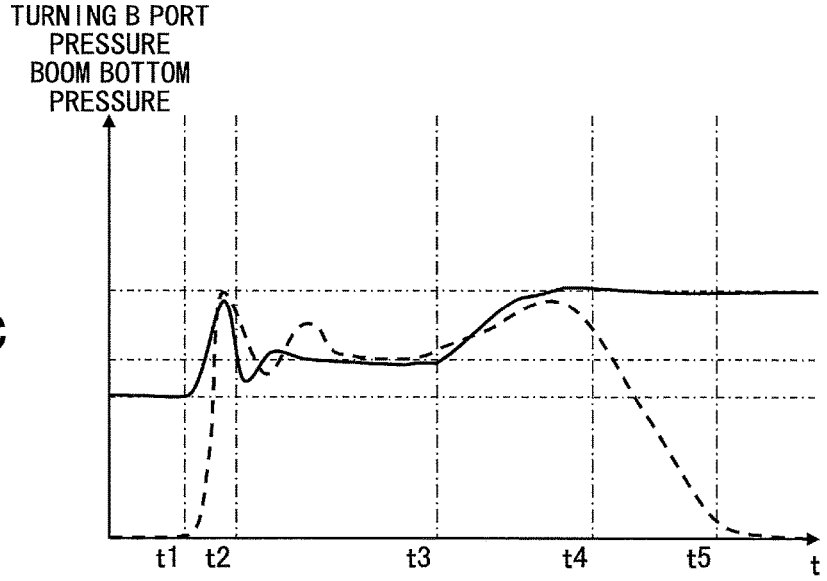

In response to determining that the detection value from the pressure sensor 70 and the detection value from the pressure sensor 72 are both maximized (Pmax) (the state from time t2 to time t3 in FIG. 3A), the determination part 30*a* outputs a control signal to the variable throttle 64 to reduce the opening. In response to receiving this control signal, the variable throttle 64 makes its opening smaller than a normal opening. When the opening of the variable throttle 64 is reduced, the resistance of the oil passage through which the hydraulic oil of the pilot pressure returns toward the lever 26A for boom operation increases to make it difficult for the hydraulic oil of the pilot pressure to return toward the lever 26A. Accordingly, as shown in FIG. 5A, the rate of decrease of the pilot pressure for boom operation (solid line) from time t3 decreases. FIGS. 5A, 5B and 5C are graphs showing changes in pilot pressures, changes in the boom velocity and the turning rotational speed, and changes in the boom bottom pressure and the turning B port pressure, respectively, in the case of reducing the opening of the variable throttle 64 before time t3 under the same operating conditions as the lever operations shown in FIGS. 3A through 3C.

That is, when a turning operation and a boom raising operation are simultaneously performed, the opening of the variable throttle 64 is reduced, for example, around time t2, and when the boom raising operation is thereafter stopped, the pilot pressure for boom operation decreases to near zero more slowly than in the case of stopping a boom raising operation performed alone. Then, the boom velocity (solid line) slowly decreases from time t3 as shown in FIG. 5B without a rapid decrease from time t3 as shown in FIG. 3B, and becomes zero at time t4 without varying (swinging). Because the boom 4 slowly comes to a stop, the variations in the boom bottom pressure between time t3 and time t4 as shown in FIG. 3C are absent. Accordingly, as shown in FIG. 5C, the boom bottom pressure (solid line) smoothly increases from time t3 to become a substantially constant pressure (a pressure due to the weight of the boom 4) at time t4. Therefore, the variations between time t3 and time t4 as shown in FIG. 3C are not caused in the turning B port pressure (dashed line), and an impact to or a swing of the upper-part turning body 3 in the turning direction is prevented.

The time to reduce the opening of the variable throttle 64 may be when it is determined that a turning operation and a boom raising operation are simultaneously performed, and is before time t3. Furthermore, when the opening of the variable throttle 64 is too small (when the throttling is excessive), the stopping of the supply of hydraulic oil to the boom cylinder 7 is delayed to delay the stopping of the boom 4. Therefore, the action of the boom 4 is slow to respond to the operation of the lever 26A, thus degrading the operability of the boom 4. Accordingly, the degree of throttling by the variable throttle 64 is set to an appropriate value in consideration of the responsive action of the boom 4.

Thus, providing the variable throttle 64 in the pilot cushion circuit 60 makes it possible to gently decrease the pilot pressure for boom operation and accordingly to prevent the swinging of the boom bottom pressure. This makes it possible to prevent the swinging of a hydraulic pressure at the turning B port (hydraulic supply side port) of the turning hydraulic motor 21B. As a result, it is possible to control and reduce the swinging of the vehicle body.

Figure 6:
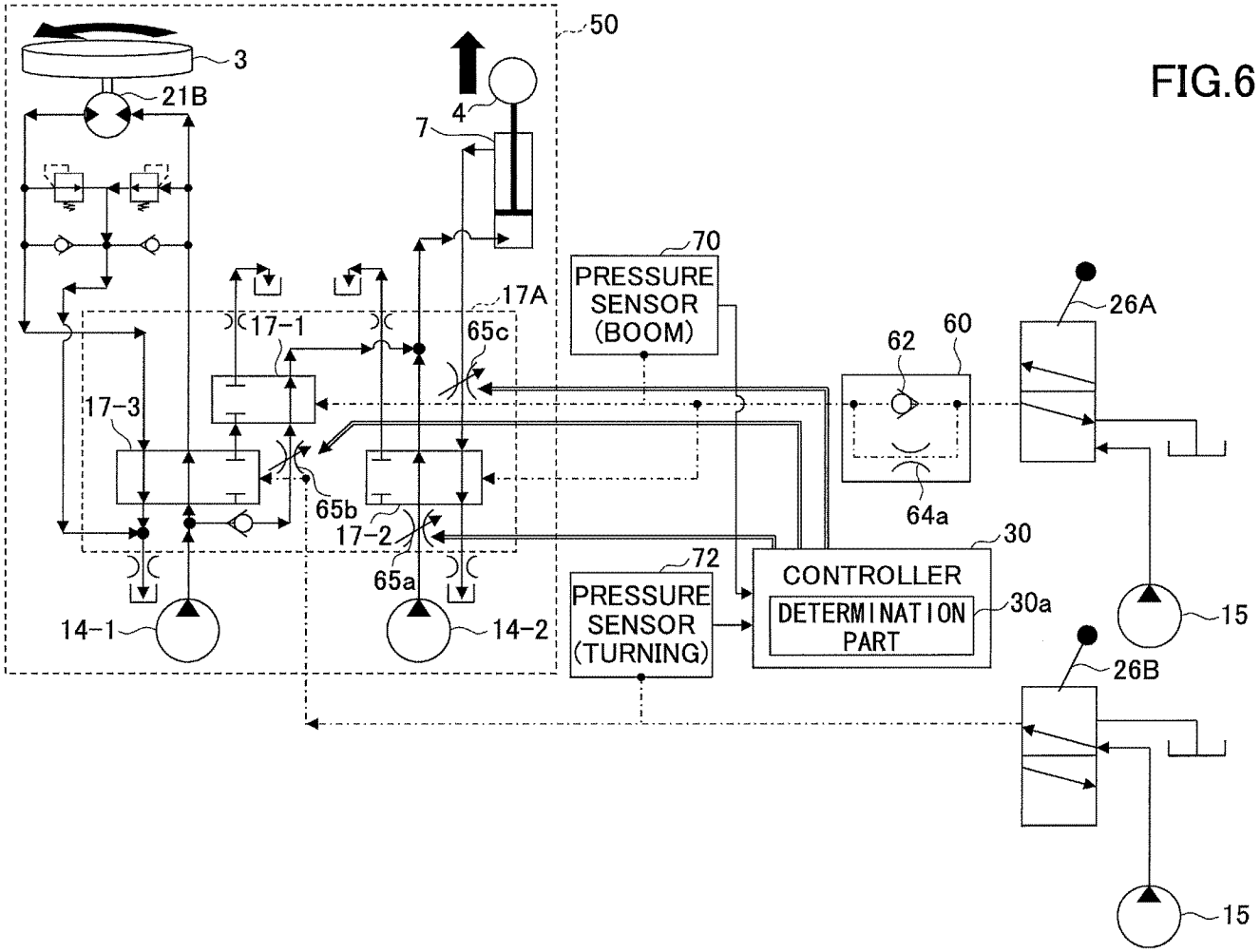
FIG. 6 is a circuit diagram showing another configuration of a hydraulic drive circuit.

Next, another configuration of a hydraulic drive circuit including a pilot hydraulic circuit is described with reference to FIG. 6. FIG. 6 is a circuit diagram of a hydraulic drive circuit. Furthermore, the hydraulic drive circuit of FIG. 6 is different from the hydraulic drive circuit of FIG. 4 in that a fixed throttle 64*a* is provided in place of the variable throttle 64 and that variable throttles 65*a* through 65*c* are provided in the hydraulic circuit part 17A, but is otherwise the same as the hydraulic drive circuit of FIG. 4. Therefore, a description of commonalities is omitted, and differences are described in detail.

The fixed throttle 64*a* forms an oil passage for returning hydraulic oil generating a pilot pressure for boom operation to the tank when reducing the pilot pressure to zero. The fixed throttle 64*a* controls the flow rate of the hydraulic oil flowing through the oil passage (return oil) to control the rate at which the spools of the spool valves 17-1 and 17-2 return to the neutral position (hereinafter referred to as "spool return speed"). The fixed throttle 64*a*, however, has its opening fixed, and therefore, does not change the spool return speed, and thus the deceleration of the boom 4 at the time of stopping the boom 4, in accordance with operating conditions, etc.

Therefore, the hydraulic drive circuit of FIG. 6 controls the variable throttles 65*a* through 65*c* in the control valve 17 instead of the variable throttle 64 in the pilot cushion circuit 60 to make it possible to change the deceleration at the time of stopping the boom 4 in accordance with operating conditions, etc.

The variable throttles 65*a* through 65*c* are valves capable of varying their openings based on signals from the controller 30.

The variable throttle 65*a* is disposed between the main pump 14-2 and the spool valve 17-2, and reduces the flow rate of hydraulic oil flowing from the main pump 14-2 to the boom cylinder 7 as its opening is reduced. The variable throttle 65*a* may alternatively be disposed between the spool valve 17-2 and the boom cylinder 7 on its downstream side.

The variable throttle 65*b* is disposed between the main pump 14-1 and the spool valve 17-1, and reduces the flow rate of hydraulic oil flowing from the main pump 14-1 to the boom cylinder 7 as its opening is reduced. The variable throttle 65*b* may alternatively be disposed between the spool valve 17-1 and the boom cylinder 7 on its downstream side.

The variable throttle 65*c* is disposed between the boom cylinder 7 and the spool valve 17-2 on its downstream side, and reduces the flow rate of hydraulic oil flowing from the boom cylinder 7 to the tank as its opening is reduced. The variable throttle 65*c* may alternatively be disposed between the spool valve 17-2 and the tank on its downstream side.

The controller 30 reduces the openings of the variable throttles 65*a* through 65*c* to predetermined target openings over a predetermined control time when the lever 26A for boom operation is returned to the neutral position. According to this embodiment, a target opening at the time of stopping the boom 4 during the complex turning action is greater than a target opening at the time of stopping the boom 4 during the single action of boom raising. That is, the controller 30 controls the openings of the variable throttles 65*a* through 65*c* so that the respective openings at the time of stopping the boom 4 during the complex turning action are greater than the openings at the time of stopping the boom 4 during the single action of boom raising. Furthermore, the control time at the time of stopping the boom 4 during the complex turning action is greater than the control time at the time of stopping the boom 4 during the single action of boom raising. That is, the controller 30 reduces the openings of the variable throttles 65*a* through 65*c* more slowly at the time of stopping the boom 4 during the complex turning action than at the time of stopping the boom 4 during the single action of boom raising, in order to cause the deceleration at the time of stopping the boom 4 during the complex turning action to be less than the deceleration at the time of stopping the boom 4 during the single action of boom raising to prevent the upper-part turning body 3 from swinging in the turning direction. As a result, the controller 30 can prevent the swinging of the vehicle body with which the operator feels uncomfortable. Either the control time or the target openings, however, may be common to the time of stopping the boom 4 during the complex turning action and the time of stopping the boom 4 during the single action of boom raising.

Rapidly reducing the opening of each of the variable throttle 65*a* and the variable throttle 65*c* produces the same effect as if the spool of the spool valve 17-2, whose spool return speed is restricted by the fixed throttle 64*a*, were rapidly returned to the neutral position. Furthermore, rapidly reducing the opening of the variable throttle 65*b* produces the same effect as if the spool of the spool valve 17-1, whose spool return speed is restricted by the fixed throttle 64*a*, were rapidly returned to the neutral position. That is, even when the spool return speed of each of the spool valves 17-1 and 17-2 is not controllable, the controller 30 makes it possible to substantively control the spool return speed by controlling the opening of each of the variable throttles 65*a* through 65*c*. As a result, it is possible to control the deceleration at the time of stopping the boom 4 the same as in the case of controlling the variable throttle 64 of FIG. 4.

Figure 7:
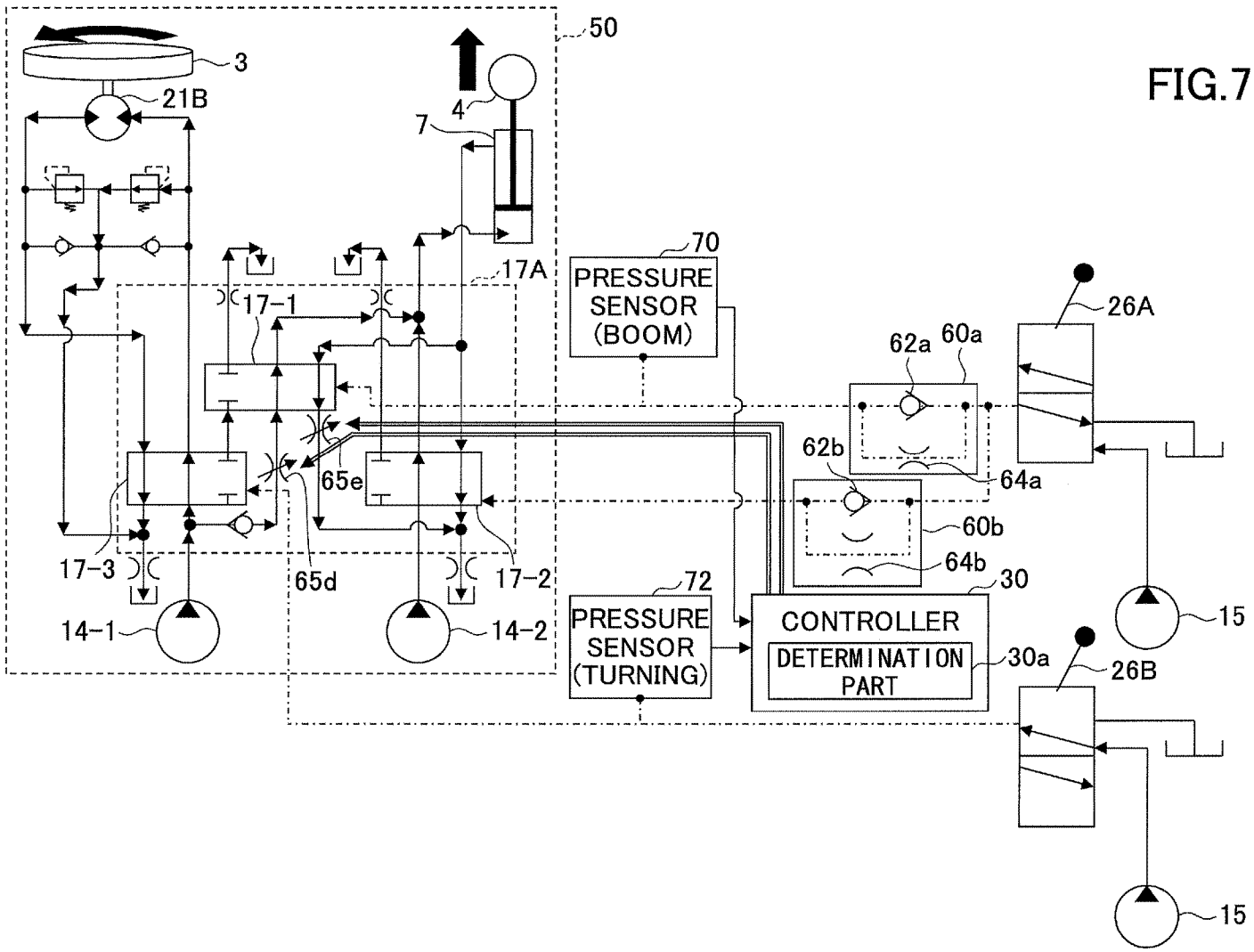
FIG. 7 is a circuit diagram showing yet another configuration of a hydraulic drive circuit.

Next, yet another configuration of a hydraulic drive circuit is described with reference to FIG. 7. FIG. 7 is a circuit diagram of a hydraulic drive circuit. The hydraulic drive circuit of FIG. 7 is different from the hydraulic drive circuit of FIG. 4 in that independent pilot cushion circuits 60*a* and 60*b* are provided for the spool valves 17-1 and 17-2, respectively, and that the fixed throttle 64*a* and a fixed throttle 64*b* are provided instead of the variable throttle 64. Furthermore, the hydraulic drive circuit of FIG. 7 is different from the hydraulic drive circuit of FIG. 4 in that variable throttles 65*d* and 65*e* are provided in the hydraulic circuit part 17A and that a CT port (a port causing the boom cylinder 7 to communicate with the tank) is added to the spool valve 17-1. The hydraulic drive circuit of FIG. 7 and the hydraulic drive circuit of FIG. 4, however, are otherwise the same. Therefore, a description of commonalities is omitted, and differences are described in detail.

The fixed throttles 64*a* and 64*b* form oil passages for returning hydraulic oil generating a pilot pressure for boom operation to the tank when reducing the pilot pressure to zero. Furthermore, the fixed throttle 64*a* restricts the flow rate of return oil with respect to the spool valve 17-1 to restrict the spool return speed of the spool valve 17-1. Likewise, the fixed throttle 64*b* restricts the flow rate of return oil with respect to the spool valve 17-2 to restrict the spool return speed of the spool valve 17-2. Check valves 62*a* and 62*b*, which are valves that prevent the hydraulic oil generating the pilot pressure from flowing toward the tank, correspond to the check valve 62 of FIG. 4.

Furthermore, according to this embodiment, the opening of the fixed throttle 64*a* is smaller than the opening of the fixed throttle 64*b*. Therefore, when the lever 26A for boom operation is returned to the neutral position, the spool valve 17-1 returns to the neutral position more slowly than the spool valve 17-2.

The fixed throttles 64*a* and 64*b*, however, have their respective openings fixed, and therefore, do not change the spool return speed, and thus the deceleration of the boom 4 at the time of stopping the boom 4, in accordance with operating conditions, etc.

Therefore, the hydraulic drive circuit of FIG. 7 controls the variable throttles 65*d* and 65*e* in the control valve 17 instead of the variable throttle 64 in the pilot cushion circuit 60 to make it possible to change the deceleration at the time of stopping the boom 4 in accordance with operating conditions, etc.

The variable throttles 65*d* and 65*e* are valves capable of varying their openings based on signals from the controller 30.

The variable throttle 65*d* is disposed between the main pump 14-1 and the spool valve 17-1, and reduces the flow rate of hydraulic oil flowing from the main pump 14-1 to the boom cylinder 7 as its opening is reduced. The variable throttle 65*d* may alternatively be disposed between the spool valve 17-1 and the boom cylinder 7 on its downstream side.

The variable throttle 65*e* is disposed between the spool valve 17-1 and the tank on its downstream side, and reduces the flow rate of hydraulic oil flowing from the boom cylinder 7 to the tank as its opening is reduced. The variable throttle 65*e* may alternatively be disposed between the boom cylinder 7 and the spool valve 17-1 on its downstream side.

The controller 30 reduces the openings of the variable throttles 65*d* and 65*e* to predetermined target openings over a predetermined control time when the lever 26A for boom operation is returned to the neutral position. According to this embodiment, a target opening at the time of stopping the boom 4 during the complex turning action is greater than a target opening at the time of stopping the boom 4 during the single action of boom raising. That is, the controller 30 controls the openings of the variable throttles 65*d* and 65*e* so that the respective openings at the time of stopping the boom 4 during the complex turning action are greater than the openings at the time of stopping the boom 4 during the single action of boom raising. Furthermore, the control time at the time of stopping the boom 4 during the complex turning action is greater than the control time at the time of stopping the boom 4 during the single action of boom raising. That is, the controller 30 reduces the openings of the variable throttles 65*d* and 65*e* more slowly at the time of stopping the boom 4 during the complex turning action than at the time of stopping the boom 4 during the single action of boom raising, in order to cause the deceleration at the time of stopping the boom 4 during the complex turning action to be less than the deceleration at the time of stopping the boom 4 during the single action of boom raising to prevent the upper-part turning body 3 from swinging in the turning direction. As a result, the controller 30 can prevent the swinging of the vehicle body with which the operator feels uncomfortable. Either the control time or the target openings, however, may be common to the time of stopping the boom 4 during the complex turning action and the time of stopping the boom 4 during the single action of boom raising.

Rapidly reducing the opening of each of the variable throttle 65*d* and the variable throttle 65*e* produces the same effect as if the spool of the spool valve 17-1, whose spool return speed is restricted by the fixed throttle 64*a*, were rapidly returned to the neutral position. That is, even when the spool return speed of the spool valve 17-1 is not controllable, the controller 30 makes it possible to substantively control the spool return speed by controlling the opening of each of the variable throttles 65*d* through 65*e*. As a result, it is possible to control the deceleration at the time of stopping the boom 4 the same as in the case of controlling the variable throttle 64 of FIG. 4.

Alternatively, the opening of the fixed throttle 64*a* may be greater than the opening of the fixed throttle 64*b*. In this case, when the lever 26A for boom operation is returned to the neutral position, the spool valve 17-2 returns to the neutral position more slowly than the spool valve 17-1. Therefore, the variable throttle 65*d* is disposed between the main pump 14-2 and the spool valve 17-2 or between the spool valve 17-2 and the boom cylinder 7 on its downstream side. Furthermore, the variable throttle 65*e* is disposed between the spool valve 17-2 and the tank on its downstream side or between the boom cylinder 7 and the spool valve 17-2 on its downstream side. As a result, even when the spool return speed of the spool valve 17-2 is not controllable, the controller 30 makes it possible to substantively control the spool return speed by controlling the opening of each of the variable throttles 65*d* and 65*e*. As a result, it is possible to control the deceleration at the time of stopping the boom 4 the same as in the case of controlling the variable throttle 64 of FIG. 4.

In the above description, the swinging of the vehicle body due to the influence of changes in the pilot pressure over the driving of the turning hydraulic motor 21B is described, while it is also possible to control the swinging of the vehicle body associated with other operating conditions by providing a variable throttle.

For example, when the pilot pressure for boom operation rapidly decreases at the time of stopping the operation of raising the boom 4, the bottom pressure of the boom cylinder 7 varies (swings), so that the boom 4 stops while swinging upward and downward (vertically) (the swinging of the boom bottom pressure between time t3 and time t4 of FIG. 3C). Such swinging of the boom 4 may cause an impact to or a swing of the upper-part turning body 3 in a vertical direction (a direction of motion of the boom 4).

At this point, as the arm 5 attached to the end of the boom 4 is more widely open, the moment of inertia of the boom 4 is greater, so that a backlash due to rapid deceleration also is greater. Accordingly, an impact or swing applied to the vehicle body differs between the case of rapidly decelerating the boom 4 in the state where the arm 5 is closed (referred to as short-reach state) and the case of rapidly decelerating the boom 4 in the state where the arm 5 is wide open (referred to as long-reach state). That is, even in the case where a pilot cushion (for example, the opening of a fixed throttle) is so controlled as to hardly cause an impact to or a swing of the vehicle body at the time of rapidly decelerating the boom 4 in the state where the arm 5 is closed (short-reach state), the impact to or the swing of the vehicle body may be magnified to give the operator an unpleasant feeling if the boom 4 is rapidly decelerated in the state where the arm 5 is wide open (long-reach state).

Providing a variable throttle in the pilot cushion circuit 60 or the control valve 17 as in the above-described embodiment, however, makes it possible to control the swinging of the boom bottom pressure by, for example, reducing the opening of the variable throttle 64 in the long-reach state. This makes it possible to control and reduce an impact to or a swing of the vehicle body in a vertical direction that is caused when the rising of the boom 4 is stopped not during a turning action but in the long-reach state.

In this case, the determination part 30*a* determines whether the state is the long-reach state, and supplies a control signal to the variable throttle in response to the state being the long-reach state. The determination as to whether the state is the long-reach state may be performed based on, for example, the detection value of an angle detection sensor that detects the angle of the arm 5 relative to the boom 4.

The control of a variable throttle during complex turning and the control of a variable throttle in the long-reach state may of course be combined.

Furthermore, while a description is given of the case of the complex action of boom raising and turning in the above-described embodiment, the opening of a variable throttle may also be controlled in the case of determining that the complex action of the arm 5 and turning is performed.

Figure 8:
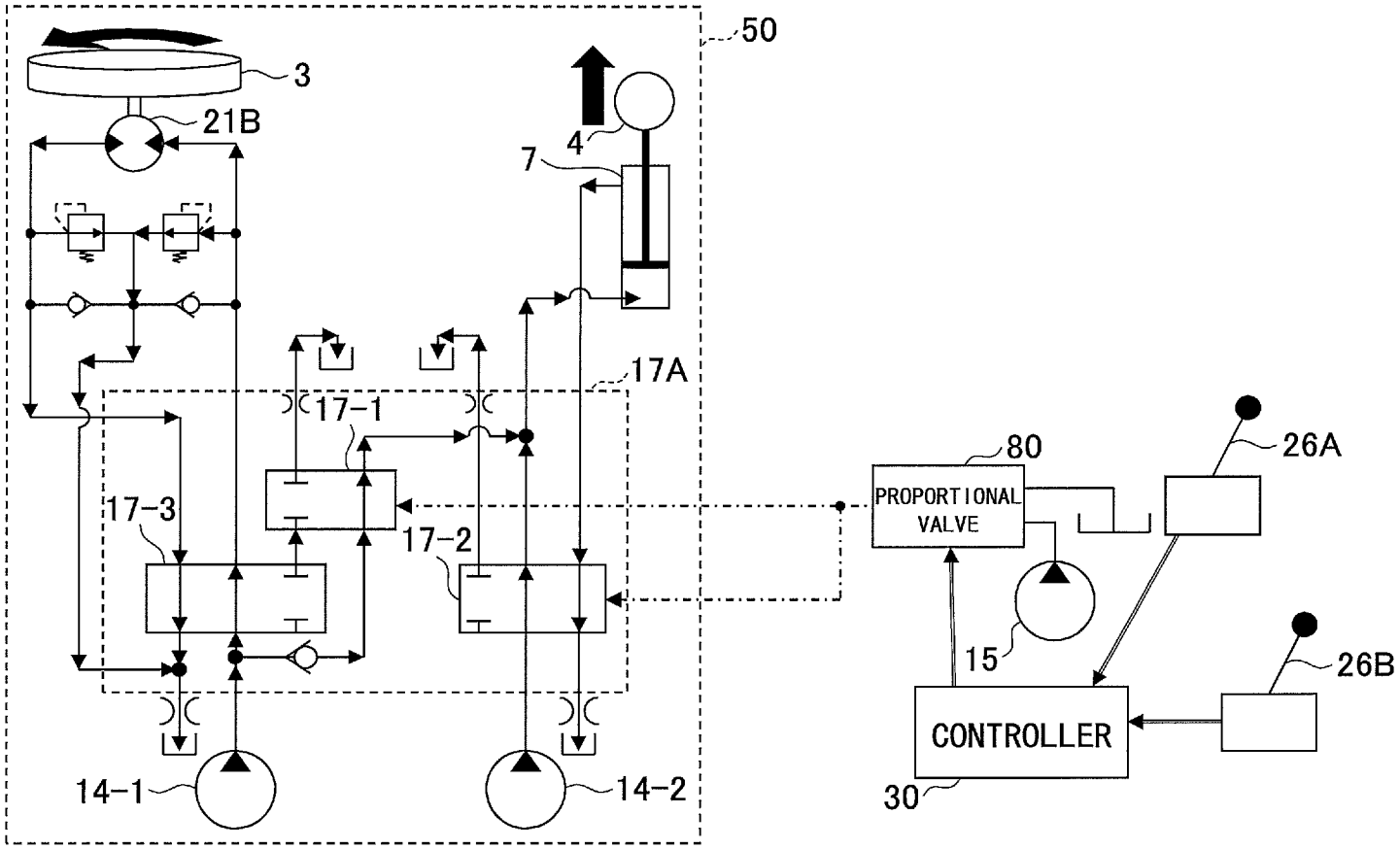
FIG. 8 is a circuit diagram of a hydraulic drive circuit in the case of controlling a pilot pressure with a proportional valve.

The above-described pilot hydraulic circuit that generates a pilot pressure may also be implemented by a proportional valve electrically controlled by the controller 30. In this case, the proportional valve operates as a variable throttle according to the above-described embodiment. FIG. 8 is a circuit diagram of a hydraulic drive circuit in the case of controlling a pilot pressure with a proportional valve 80.

In FIG. 8, a signal representing the amount of operation of the lever 26A for boom operation and a signal representing the amount of operation of the lever 26B for turning operation are supplied to the controller 30. The controller 30 controls hydraulic oil from the pilot pump 15 to an appropriate pilot pressure based on the these signals, and supplies the hydraulic oil to the spool valves 17-1, 17-2, and 17-3. Furthermore, if there is a rapid change in the amount of operation when the lever 26A is returned to the neutral position, the controller 30 controls the proportional valve 80 so that the pilot pressure changes as shown in FIG. 5A.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. A shovel has been described based on embodiments of the present invention. It should be understood, however, that various changes, substitutions, and alterations could be made hereto without departing from the spirit and scope of the invention.

What is claimed is:

1. A shovel, comprising:

a turning hydraulic motor configured to be driven with hydraulic oil supplied from a hydraulic pump to drive a turning body of the shovel to turn;

a hydraulic cylinder configured to be driven with the hydraulic oil supplied from the hydraulic pump;

an operation lever configured to be operated to drive the hydraulic cylinder;

a pilot circuit configured to control a pilot pressure in accordance with an operation of an operation lever;

a hydraulic control valve configured to control the hydraulic oil supplied from the hydraulic pump to the hydraulic cylinder in accordance with the pilot pressure supplied from the pilot circuit;

a variable throttle or a proportional valve, whose opening varies in accordance with a state of the operation of the operation lever; and a controller configured to change the opening of the variable throttle or the proportional valve in accordance with a returned state of the operation lever, wherein the proportional valve is electrically controlled by the controller.

2. The shovel as claimed in claim 1, wherein the variable throttle or the proportional valve is provided in the pilot circuit, and the controller is configured to reduce the opening of the variable throttle or the proportional valve when the operation lever is operated in accordance with the returned state with the pilot pressure of the pilot circuit being increased.

3. The shovel as claimed in claim 2, wherein the controller is configured to reduce the opening of the variable throttle or the proportional valve in response to determining that the turning body is turning.

4. The shovel as claimed in claim 2, wherein the controller is configured to reduce the opening of the variable throttle or the proportional valve in response to determining that the shovel is in a long-reach state.

5. The shovel as claimed in claim 2, wherein the variable throttle or the proportional valve forms an oil passage through which the hydraulic oil of the pilot pressure flows toward a tank when the pilot pressure is reduced to zero.

6. The shovel as claimed in claim 1, wherein the variable throttle or the proportional valve is provided between the hydraulic pump and the hydraulic control valve, and the controller is configured to reduce the opening of the variable throttle or the proportional valve to a first value when the operation lever is returned toward a neutral position with the pilot pressure of the pilot circuit being increased, the first value being greater than a second value to which the opening of the variable throttle or the proportional valve is reduced when the operation lever is returned toward the neutral position with the pilot pressure of the pilot circuit being increased in a case of a single action of driving the hydraulic cylinder.

7. The shovel as claimed in claim 6, further comprising:

a throttle provided in the pilot circuit, the throttle being configured to restrict return oil to a tank when the operation lever is returned toward the neutral position with the pilot pressure of the pilot circuit being increased.

8. The shovel as claimed in claim 1, wherein the controller is configured to change the opening of the variable throttle or the proportional valve in accordance with the state of the operation of the operation lever, irrespective of a size of a load on the hydraulic cylinder.

9. The shovel as claimed in claim 1, wherein the controller is configured to detect an amount of the operation of the operation lever, and to change the opening of the variable throttle or the proportional valve in accordance with the detected amount of the operation of the operation lever.

10. A method of controlling a shovel that includes a turning hydraulic motor configured to be driven with hydraulic oil supplied from a hydraulic pump to drive a turning body of the shovel to turn, a hydraulic cylinder configured to be driven with the hydraulic oil supplied from the hydraulic pump, an operation lever configured to be operated to drive the hydraulic cylinder, a pilot circuit configured to control a pilot pressure in accordance with an operation of an operation lever, a hydraulic control valve configured to control the hydraulic oil supplied from the hydraulic pump to the hydraulic cylinder in accordance with the pilot pressure supplied from the pilot circuit, and a variable throttle or a proportional valve, whose opening varies in accordance with a state of the operation of the operation lever, the proportional valve being electrically controlled by a controller of the shovel, the method comprising:

changing, by the controller, the opening of the variable throttle or the proportional valve in accordance with a returned state of the operation lever.

11. The method of controlling a shovel as claimed in claim 10, wherein the variable throttle or the proportional valve is provided in the pilot circuit, and the opening of the variable throttle or the proportional valve is reduced when the operation lever is operated in accordance with the returned state with the pilot pressure of the pilot circuit being increased.

12. The method of controlling a shovel as claimed in claim 10, wherein the variable throttle or the proportional valve is provided between the hydraulic pump and the hydraulic control valve, and the opening of the variable throttle or the proportional valve is reduced to a first value when the operation lever is returned toward a neutral position with the pilot pressure of the pilot circuit being increased, the first value being greater than a second value to which the opening of the variable throttle or the proportional valve is reduced when the operation lever is returned toward the neutral position with the pilot pressure of the pilot circuit being increased in a case of a single action of driving the hydraulic cylinder.

* * * * *